US009677344B2

(12) United States Patent
Radford et al.

(10) Patent No.: US 9,677,344 B2
(45) Date of Patent: Jun. 13, 2017

(54) COMPONENTS OF DRILLING ASSEMBLIES, DRILLING ASSEMBLIES, AND METHODS OF STABILIZING DRILLING ASSEMBLIES IN WELLBORES IN SUBTERRANEAN FORMATIONS

(71) Applicant: Baker Hughes Incorporated, Houston, TX (US)

(72) Inventors: Steven R. Radford, The Woodlands, TX (US); Amanda K. Ohm, The Woodlands, TX (US); Ajay V. Kulkarni, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 677 days.

(21) Appl. No.: 13/783,136

(22) Filed: Mar. 1, 2013

(65) Prior Publication Data

US 2014/0246242 A1 Sep. 4, 2014

(51) Int. Cl.

| | |
|---|---|
| ***E21B 17/10*** | (2006.01) |
| ***E21B 10/54*** | (2006.01) |
| ***E21B 10/43*** | (2006.01) |

(52) U.S. Cl.

CPC ..... *E21B 10/54* (2013.01); *E21B 10/43* (2013.01); *E21B 17/1078* (2013.01); *E21B 17/1092* (2013.01)

(58) Field of Classification Search

CPC ..... E21B 17/10; E21B 17/1092

See application file for complete search history.

(56) References Cited

U.S. PATENT DOCUMENTS

| | | | |
|---|---|---|---|
| 1,678,075 | A | 7/1928 | Phipps |
| 2,069,482 | A | 2/1937 | Seay |
| 2,136,518 | A | 11/1938 | Nixon |
| 2,177,721 | A | 10/1939 | Johnson et al. |
| 2,344,598 | A | 3/1944 | Church |

(Continued)

FOREIGN PATENT DOCUMENTS

| | | | |
|---|---|---|---|
| EP | 246789 | A2 | 11/1987 |
| EP | 1036913 | A1 | 9/2000 |

(Continued)

OTHER PUBLICATIONS

International Search Report for International Application No. PCT/US2014/019404 dated Jun. 23, 2014, 3 pages.

(Continued)

*Primary Examiner* — Michael Goodwin
(74) *Attorney, Agent, or Firm* — TraskBritt

(57) ABSTRACT

A component of a drilling assembly comprises at least one blade having a gauge region comprising a bearing face for engaging a sidewall of a wellbore in a subterranean formation during rotation of the drilling assembly, and a rotationally leading edge rotationally preceding the bearing face and comprising an engagement profile comprising at least one of at least one chamfered surface and at least one radiused surface, the engagement profile different than another engagement profile of another rotationally leading edge of another region of the at least one blade. A drilling assembly, and a method for stabilizing a drilling assembly in a wellbore in a subterranean formation are also provided.

20 Claims, 6 Drawing Sheets

(56) References Cited

U.S. PATENT DOCUMENTS

| | | | | |
|---|---|---|---|---|
| 2,532,418 | A | 12/1950 | Page | |
| 2,638,988 | A | 5/1953 | Williams | |
| 2,754,089 | A | 7/1956 | Kammerer, Jr. | |
| 2,758,819 | A | 8/1956 | Kammerer, Jr. | |
| 2,834,578 | A | 5/1958 | Carr | |
| 2,874,784 | A | 2/1959 | Baker, Jr. et al. | |
| 2,882,019 | A | 4/1959 | Carr et al. | |
| 3,083,765 | A | 4/1963 | Kammerer | |
| 3,105,562 | A | 10/1963 | Stone et al. | |
| 3,123,162 | A | 3/1964 | Rowley | |
| 3,126,065 | A | 3/1964 | Chadderdon | |
| 3,171,502 | A | 3/1965 | Kammerer | |
| 3,211,232 | A | 10/1965 | Grimmer | |
| 3,224,507 | A | 12/1965 | Cordary, Jr. | |
| 3,283,834 | A | 11/1966 | Kammerer | |
| 3,289,760 | A | 12/1966 | Kammerer | |
| 3,351,137 | A | 11/1967 | Schulz et al. | |
| 3,425,500 | A | 2/1969 | Fuchs | |
| 3,433,313 | A | 3/1969 | Brown | |
| 3,556,233 | A | 1/1971 | Gilreath | |
| 4,277,869 | A | 7/1981 | Hartwell | |
| 4,403,659 | A | 9/1983 | Upchurch | |
| 4,458,761 | A | 7/1984 | Van Vreeswyk | |
| 4,545,441 | A | 10/1985 | Williamson | |
| 4,589,504 | A | 5/1986 | Simpson | |
| 4,660,657 | A | 4/1987 | Furse et al. | |
| 4,690,229 | A | 9/1987 | Raney | |
| 4,693,328 | A | 9/1987 | Furse et al. | |
| 4,842,083 | A | 6/1989 | Raney | |
| 4,848,490 | A | 7/1989 | Anderson | |
| 4,854,403 | A | 8/1989 | Ostertag et al. | |
| 4,884,477 | A | 12/1989 | Smith et al. | |
| 4,889,197 | A | 12/1989 | Boe | |
| 4,893,678 | A | 1/1990 | Stokley et al. | |
| 5,139,098 | A | 8/1992 | Blake | |
| 5,211,241 | A | 5/1993 | Mashaw et al. | |
| 5,224,558 | A | 7/1993 | Lee | |
| 5,265,684 | A | 11/1993 | Rosenhauch | |
| 5,293,945 | A | 3/1994 | Rosenhauch et al. | |
| 5,305,833 | A | 4/1994 | Collins | |
| 5,318,131 | A | 6/1994 | Baker | |
| 5,318,137 | A | 6/1994 | Johnson et al. | |
| 5,318,138 | A | 6/1994 | Dewey et al. | |
| 5,332,048 | A | 7/1994 | Underwood et al. | |
| 5,343,963 | A | 9/1994 | Bouldin et al. | |
| 5,361,859 | A | 11/1994 | Tibbitts | |
| 5,363,931 | A * | 11/1994 | Moriarty | F16L 7/00 166/241.7 |
| 5,368,114 | A | 11/1994 | Tandberg et al. | |
| 5,375,662 | A | 12/1994 | Echols, III et al. | |
| 5,425,423 | A | 6/1995 | Dobson et al. | |
| 5,437,308 | A | 8/1995 | Morin et al. | |
| 5,443,129 | A | 8/1995 | Bailey et al. | |
| 5,553,678 | A | 9/1996 | Barr et al. | |
| 5,560,440 | A | 10/1996 | Tibbitts | |
| 5,740,864 | A | 4/1998 | de Hoedt et al. | |
| 5,788,000 | A | 8/1998 | Maury et al. | |
| 5,823,254 | A | 10/1998 | Dobson et al. | |
| 5,862,870 | A | 1/1999 | Hutchinson | |
| 5,887,655 | A | 3/1999 | Haugen et al. | |
| 6,006,845 | A * | 12/1999 | Illerhaus | E21B 17/1092 175/393 |
| 6,039,131 | A | 3/2000 | Beaton | |
| 6,059,051 | A | 5/2000 | Jewkes et al. | |
| 6,070,677 | A | 6/2000 | Johnston | |
| 6,109,354 | A | 8/2000 | Ringgenberg et al. | |
| 6,116,336 | A | 9/2000 | Adkins et al. | |
| 6,131,675 | A | 10/2000 | Anderson | |
| 6,173,795 | B1 | 1/2001 | McGarian et al. | |
| 6,189,631 | B1 | 2/2001 | Sheshtawy | |
| 6,213,226 | B1 | 4/2001 | Eppink et al. | |
| 6,223,840 | B1 | 5/2001 | Swietlik | |
| 6,227,312 | B1 | 5/2001 | Eppink et al. | |
| 6,230,557 | B1 | 5/2001 | Ciglenec | |
| 6,248,149 | B1 | 6/2001 | Massey et al. | |
| 6,289,999 | B1 | 9/2001 | Dewey et al. | |
| 6,325,151 | B1 | 12/2001 | Vincent et al. | |
| 6,349,779 | B1 | 2/2002 | Gilbert | |
| 6,378,632 | B1 | 4/2002 | Dewey | |
| 6,488,104 | B1 | 12/2002 | Eppink et al. | |
| 6,494,272 | B1 | 12/2002 | Eppink et al. | |
| 6,615,933 | B1 | 9/2003 | Eddison | |
| 6,668,936 | B2 | 12/2003 | Williamson, Jr. et al. | |
| 6,668,949 | B1 | 12/2003 | Rives | |
| 6,681,860 | B1 | 1/2004 | Yokley et al. | |
| 6,702,020 | B2 | 3/2004 | Zachman et al. | |
| 6,708,785 | B1 | 3/2004 | Russell et al. | |
| 6,732,817 | B2 | 5/2004 | Dewey et al. | |
| 7,048,078 | B2 | 5/2006 | Dewey et al. | |
| 7,314,099 | B2 | 1/2008 | Dewey et al. | |
| 7,513,318 | B2 | 4/2009 | Underwood et al. | |
| 7,900,717 | B2 | 3/2011 | Radford et al. | |
| 8,002,052 | B2 | 8/2011 | Stevens et al. | |
| 8,079,428 | B2 | 12/2011 | Lyons et al. | |
| 8,905,163 | B2 * | 12/2014 | Chen | E21B 7/04 175/408 |
| 2002/0070052 | A1 | 6/2002 | Armell | |
| 2003/0029644 | A1 | 2/2003 | Hoffmaster et al. | |
| 2009/0145666 | A1 | 6/2009 | Radford et al. | |
| 2009/0242277 | A1 | 10/2009 | Radford | |
| 2011/0073330 | A1 | 3/2011 | Radford | |
| 2011/0284233 | A1 | 11/2011 | Wu et al. | |

FOREIGN PATENT DOCUMENTS

| | | | | |
|---|---|---|---|---|
| GB | 2328964 | A | 3/1999 | |
| GB | 2344607 | A | 6/2000 | |
| GB | 2344122 | B | 4/2003 | |
| GB | 2462813 | A * | 2/2010 | E21B 17/1092 |
| WO | 0031371 | A1 | 6/2000 | |

OTHER PUBLICATIONS

International Written Opinion for International Application No. PCT/US2014/019404 dated Jun. 23, 2014, 11 pages.

International Preliminary Report on Patentability for International Application No. PCT/US2014/019404 dated Sep. 1, 2015, 12 pages.

* cited by examiner

COMPONENTS OF DRILLING ASSEMBLIES, DRILLING ASSEMBLIES, AND METHODS OF STABILIZING DRILLING ASSEMBLIES IN WELLBORES IN SUBTERRANEAN FORMATIONS

FIELD

Embodiments of the disclosure relate generally to components of drilling assemblies for drilling, reaming, conditioning, or exploring wellbores in subterranean formations, to drilling assemblies, and to methods of stabilizing drilling assemblies in wellbores in subterranean formations. More particularly, embodiments of the disclosure relate to at least one component of a drilling assembly including a gauge region exhibiting a relatively passive rotationally leading edge engagement profile, to related drilling assemblies, and to related methods of stabilizing drilling assemblies in wellbores in subterranean formations.

BACKGROUND

Wellbores are formed in subterranean formations for various purposes including, for example, extraction of oil and gas from the subterranean formations and extraction of geothermal heat from the subterranean formations. A wellbore may be formed in a subterranean formation using a drilling assembly including a drill bit coupled, either directly or indirectly, to a distal end of a drill string that includes a series of elongated tubular segments connected end-to-end and extending into the wellbore from the surface of the subterranean formation.

The drill bit can be any conventional earth-boring rotary drill bit, such as a fixed-cutter drill bit (also known in the art as a "drag" bit), a roller cone drill bit (also known in the art as a "rock" bit), a diamond-impregnated bit, or a hybrid bit (which may include, for example, both fixed-cutters and roller cone cutters). For example, the drill bit can be a fixed-cutter drill bit, which typically includes a plurality of wings or blades each carrying multiple cutting elements configured and positioned to cut, crush, shear, and/or abrade away material of the subterranean formation as the drill bit is rotated under an applied axially force (known in the art as "weight-on-bit") to form a pilot borehole therein.

The drill string can include a variety of components (e.g., tools), such as one or more of an expandable reamer, an expandable stabilizer, and a fixed stabilizer. The expandable reamer can include expandable reamer blades configured for enlarging the pilot borehole formed by the drill bit to form an expanded borehole in the subterranean formation. The expandable stabilizer is typically provided above (i.e., "uphole" of) the expandable reamer, and can include expandable stabilizer blades configured to extend to a diameter of the expanded borehole to increase the stability of the drilling assembly during the operation thereof. In turn, the fixed stabilizer is typically provided below (i.e., "down-hole" of) the expandable reamer, and can include fixed stabilizer blades configured to extend to a diameter of the pilot borehole to increase the stability of the drilling assembly during the operation thereof. The fixed stabilizer can also be provided at other locations along the drill string. The drill string can, optionally, be run through the pilot borehole in the subterranean formation without the drill bit coupled thereto.

Disadvantageously, the radially outermost surfaces and edges of one or more components of a conventional drilling assembly can contribute to vibrational instabilities during the operation of the drilling assembly. For example, gauge regions (i.e., regions which define the outermost radii of particular components of the drilling assembly) of the blades of one or more components (e.g., the drill bit, the expandable reamer, the expandable stabilizer, and the fixed stabilizer) of the drilling assembly can be configured with relatively sharp and aggressive rotationally leading edge engagement profiles that can cause the gauge region of the blade to undesirably dig into or catch the inside of a borehole (e.g., the pilot borehole, or the expanded borehole) sidewall, inducing whirl and stick slip vibrations during operation of the drilling assembly.

Accordingly, it would be desirable to have drilling assembly components, drilling assemblies, and methods of stabilizing drilling assemblies, facilitating enhanced stability during operations to form a wellbore in a subterranean formation as compared to conventional drilling assembly components, drilling assemblies, and methods of stabilizing drilling assemblies. It would be further desirable, if the formation-engaging surfaces and edges of the gauge regions of the drilling assembly components were sufficiently wear-resistant to form the wellbore in the subterranean formation without undergoing excessive wear (e.g., abrasive wear, erosive wear) so as to prolong the operational life of the drilling assembly components and the drilling assembly.

BRIEF SUMMARY

Embodiments described herein include components of drilling assemblies, drilling assemblies, and methods of stabilizing drilling assemblies in wellbores in subterranean formations. For example, in accordance with one embodiment described herein, a component of a drilling assembly comprises at least one blade having a gauge region comprising a bearing face for engaging a sidewall of a wellbore in a subterranean formation during rotation of the drilling assembly, and a rotationally leading edge rotationally preceding the bearing face and comprising an engagement profile comprising at least one of at least one chamfered surface and at least one radiused surface, the engagement profile different than another engagement profile of another rotationally leading edge of another region of the at least one blade.

In additional embodiments, a drilling assembly comprises at least one component comprising at least one blade comprising a gauge region exhibiting a rotationally leading edge engagement profile comprising at least one of a plurality of radiused surfaces each exhibiting a different radius of curvature, and a plurality of chamfered surfaces each exhibiting a different angle relative to one another.

In yet additional embodiments, a method of stabilizing a drilling assembly in a wellbore in a subterranean formation comprises forming the drilling assembly to comprise at least one component comprising at least one blade comprising a gauge region comprising a bearing surface and a rotationally leading edge rotationally preceding the bearing surface and exhibiting an engagement profile comprising at least one of a plurality of radiused surfaces each exhibiting a different radius of curvature, and a plurality of chamfered surfaces each exhibiting a different angle relative to one another. The drilling assembly is rotated. A sidewall of the wellbore is engaged by the at least one of the plurality of radiused surfaces and the plurality of chamfered surfaces of the rotationally leading edge of the gauge region of the at least one blade of the at least one component.

DETAILED DESCRIPTION

Figure 1:
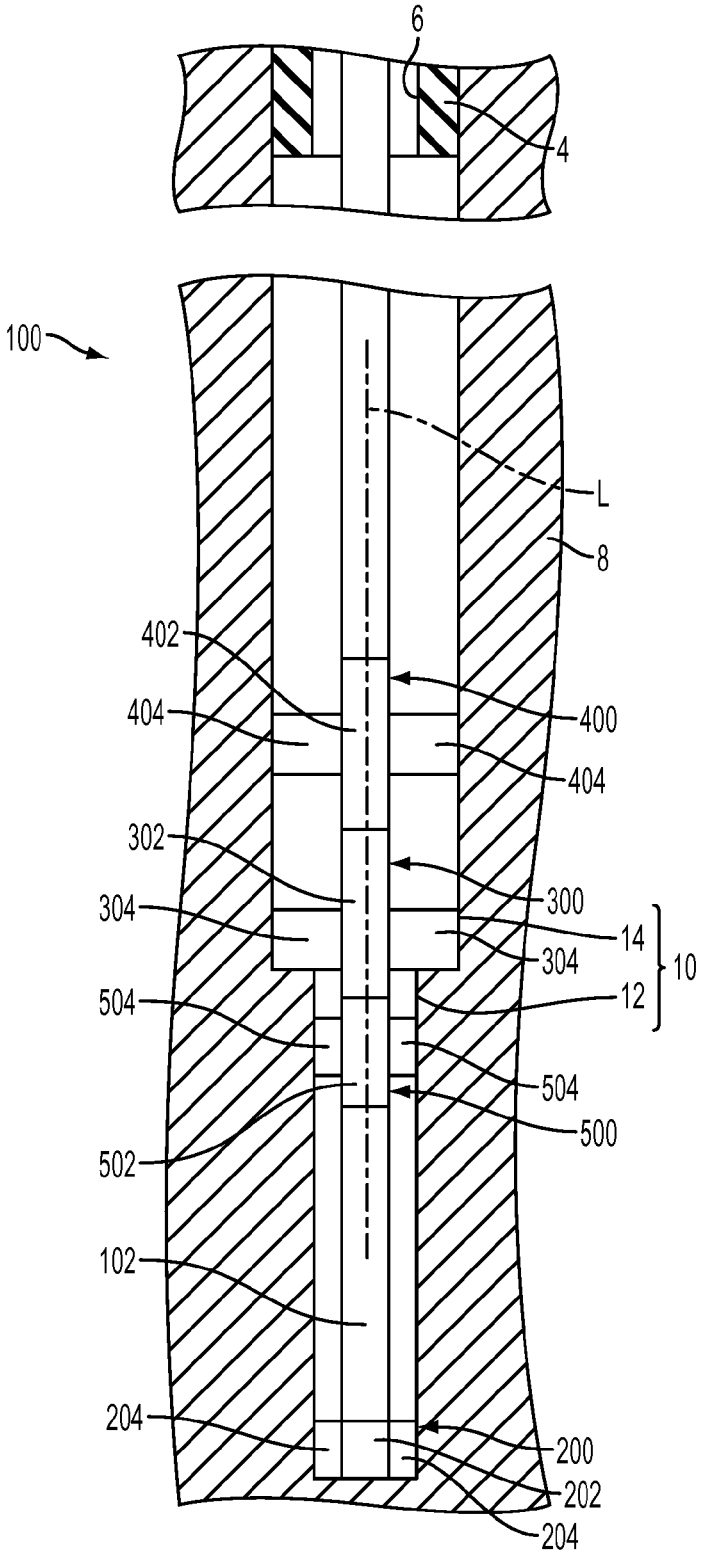
FIG. 1 is a longitudinal schematic view of a drilling assembly in accordance with an embodiment of the disclosure.

Components of drilling assemblies are disclosed, as are drilling assemblies, and methods of stabilizing drilling assemblies in wellbores in subterranean formations. In some embodiments, at least one component of a drilling assembly includes at least one blade having a gauge region including a rotationally leading edge rotationally preceding a bearing surface for laterally engaging a wall of a borehole in a subterranean formation during rotation of the drilling assembly. The rotationally leading edge exhibits an engagement profile including at least one of at least one chamfered surface and at least one radiused surface. The gauge region of the blade may also include at least one material for enhancing the wear resistance of the formation-engaging surfaces (e.g., bearing surface, the rotationally leading edge) of the gauge region. The various drilling assembly components, drilling assemblies, and methods of the disclosure may reduce vibrational instabilities during the formation of wellbores in subterranean formations as compared to conventional drilling assembly components, drilling assemblies, and methods.

In the following detailed description, reference is made to the accompanying drawings that depict, by way of illustration, specific embodiments in which the disclosure may be practiced. However, other embodiments may be utilized, and structural, logical, and configurational changes may be made without departing from the scope of the disclosure. The illustrations presented herein are not meant to be actual views of any particular material, component, apparatus, assembly, system, or method, but are merely idealized representations that are employed to describe embodiments of the present disclosure. The drawings presented herein are not necessarily drawn to scale. Additionally, elements common between drawings may retain the same numerical designation.

Although some embodiments of the disclosure are depicted as being used and employed in particular drilling assemblies and components thereof (e.g., drill bits, expandable reamers, expandable stabilizers, and fixed stabilizers), persons of ordinary skill in the art will understand that the embodiments of the disclosure may be employed in any down-hole drilling assembly, drill bit, drill string, and/or component of any thereof where it is desirable to enhance at least one of stability and wear-resistance of the drilling assembly, drill bit, drill string, and/or component of any thereof during the formation of a wellbore in a subterranean formation. By way of non-limiting example, embodiments of the disclosure may be employed in earth-boring rotary drill bits, fixed-cutter drill bits, roller cone drill bits, hybrid drill bits employing both fixed and rotatable cutting structures, core drill bits, eccentric drill bits, bicenter drill bits, expandable reamers, expandable stabilizers, fixed stabilizers, mills, and other components of a drilling assembly or drill string as known in the art.

As used herein, the singular forms "a," "an," and "the" are intended to include the plural forms as well, unless the context clearly indicates otherwise.

As used herein, the term "and/or" includes any and all combinations of one or more of the associated listed items.

As used herein, relational terms, such as "first," "second," "top," "bottom," "upper," "lower," "over," "under," etc., are used for clarity and convenience in understanding the disclosure and accompanying drawings and do not connote or depend on any specific preference, orientation, or order, except where the context clearly indicates otherwise.

As used herein, the term "substantially," in reference to a given parameter, property, or condition, means to a degree that one of ordinary skill in the art would understand that the given parameter, property, or condition is met with a small degree of variance, such as within acceptable manufacturing tolerances.

FIG. 1 is a longitudinal schematic view of drilling assembly 100 for use in accordance with an embodiment of the disclosure. As shown in FIG. 1, the drilling assembly 100 may be configured and operated to ream a wellbore 10 including a pilot borehole 12 and an expanded borehole 14 in a subterranean formation 8. The drilling assembly 100 may include a drill bit 200, an expandable reamer 300, and an expandable stabilizer 400. The expandable stabilizer 400 may be positioned over and connected (e.g., directly, or indirectly) to the expandable reamer 300, and the expandable reamer 300 may be positioned over and connected (e.g., directly, or indirectly) to the drill bit 200. Optionally, the drilling assembly 100 may also include a fixed stabilizer 500. The fixed stabilizer 500 may, for example, be positioned between and connected (e.g., directly, or indirectly) to the expandable reamer 300 and the drill bit 200. The expandable stabilizer 400, the expandable reamer 300, the fixed stabilizer 500 (if present), and the drill bit 200 may share a common longitudinal axis L. In additional embodiments, such as where the pilot borehole 12 has previously been formed in the subterranean formation 8, the drill bit 200 may, optionally, be absent from the drilling assembly 100, such that the drilling assembly 100 comprises a drill string including one or more of the expandable reamer 300, the expandable stabilizer 400, and the fixed stabilizer 500.

As depicted in FIG. 1, the drill bit 200, the expandable reamer 300, the expandable stabilizer 400, and the fixed stabilizer 500, may comprise discrete components (e.g., tools) of the drilling assembly 100 coupled together at opposing ends. Alternatively, two or more of the drill bit 200, the expandable reamer 300, the expandable stabilizer 400, and the fixed stabilizer 500 may comprise a single, integral component of the drilling assembly 100. In some embodiments, the fixed stabilizer 500 and the expandable reamer 300 comprise a single component (e.g., tool) of the drilling assembly 100. In additional embodiments, the expandable reamer 300 and the expandable stabilizer 400 comprise a single component of the drilling assembly 100. In yet additional embodiments, the fixed stabilizer 500, the expandable reamer 300, and the expandable stabilizer 400 comprise a single component of the drilling assembly 100.

Figure 2:
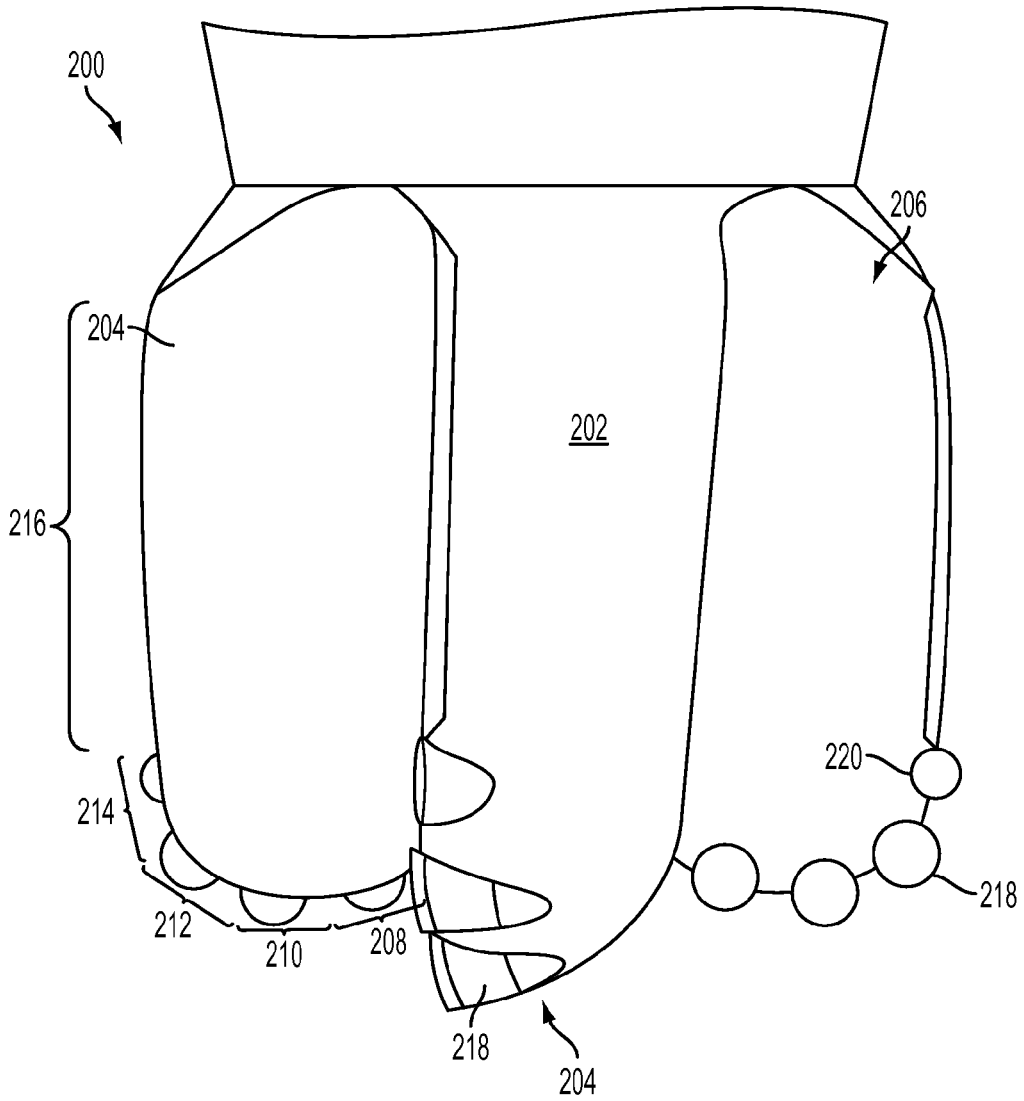
FIG. 2 is a simplified side-elevation view of a drill bit in accordance with an embodiment of the disclosure.

The drill bit 200 may be an earth-boring rotary drill configured and operated to ream the pilot borehole 12 in a down-hole direction through the subterranean formation 8. The drill bit 200 may include a bit body 202 secured (e.g., by way of a threaded member) to another component 102 (e.g., a drill collar) of the drilling assembly 100, and including bit blades 204. By way of non-limiting example, the drill bit 200 may comprise a fixed-cutter drill bit, as depicted in FIG. 2. As illustrated in FIG. 2, which is simplified side-elevation view of the drill bit 200 of FIG. 1 in accordance with an embodiment of the disclosure, the bit blades 204 of the drill bit 200 may radially project from and longitudinally extend across the bit body 202, and may be separated by junk slots 206. Each of the bit blades 204 may include a cone region 208, a nose region 210, a flank region 212, a shoulder region 214, and a gauge region 216, each configured to engage the subterranean formation 8 (FIG. 1) during reaming of the pilot borehole 12 (FIG. 1). In additional embodiments, the cone region 208 may be omitted from one or more of the bit blades 204.

The cone region 208, the nose region 210, and the flank region 212 of each of the bit blades 204 of the drill bit 200 may be configured and positioned to engage surfaces of the subterranean formation 8 at the bottom of the pilot borehole 12, and to support a majority of the weight-on-bit (WOB) applied through the drilling assembly 100 (FIG. 1). The gauge region 216 of each of the bit blades 204 may be configured and positioned to engage the subterranean formation 8 at the sidewalls of the pilot borehole 12, and the shoulder region 214 of each of the bit blades 204 may be configured and positioned to bridge the transition between the bottom of the pilot borehole 12 and the sidewalls of the pilot borehole 12. The cone region 208, nose region 210, the flank region 212, and, optionally, the shoulder region 214 of each of the bit blades 204 may carry cutting elements 218 attached within pockets 220 in faces of the bit blades 204 and configured to remove (e.g., by at least one of cutting and scraping) the subterranean formation 8 at and proximate the bottom of the pilot borehole 12. In turn, the gauge region 216 of one or more of the bit blades 204 may be configured to enhance the stability (e.g., reduce whirl and stick slip vibrations) of the drilling assembly 100 (FIG. 1) during the reaming of the wellbore 10, as described in further detail below. For example, the gauge region 216 of one or more of the bit blades 204 may be configured to substantially limit or prevent formation-engaging surfaces and edges of the gauge region 216 from digging into (e.g., catching) the sidewalls of the pilot borehole 12 during the reaming of the wellbore 10 (FIG. 1).

Referring again to FIG. 1, the expandable reamer 300 may be an expandable reamer configured and operated to ream the expanded borehole 14 between the pilot borehole 12 and another borehole 4 extending through a casing 6. As shown in FIG. 1, the expandable reamer 300 may include a tubular body 302 and expandable reamer blades 304. The tubular body 302 may include means (e.g., threaded male pin members, threaded female box members, etc.) at upper and lower ends thereof for connecting to other components of the drilling assembly 100. The expandable reamer blades 304 may be positionally retained in a circumferentially spaced relationship between the upper and lower ends of the tubular body 302, and may be symmetrically circumferentially positioned axially along the tubular body 302, or may be positioned circumferentially asymmetrically and/or longitudinally asymmetrically along the tubular body 302. The expandable reamer 300 may be configured and operated such that expandable reamer blades 304 extend or refract, as described in U.S. Pat. No. 7,900,717, which issued Mar. 8, 2011, and is titled "Expandable Reamers for Earth Boring Applications," the disclosure of which is incorporated herein in its entirety by this reference. For example, the expandable reamer 300 may be configured and operated such that the expandable reamer blades 304 are initially retained in refracted positions within the tubular body 302, and may be moved (e.g., by application or removal of hydraulic pressure) between extended positions (shown in FIG. 1) and retracted positions (not shown) as desired. The expandable reamer blades 304 may engage the subterranean formation 8 in an extended position (e.g., to form the sidewalls of the extended borehole 14), but may not engage the subterranean formation 8 in a refracted position. The expandable reamer 300 may include one, two, three, or more than three of the expandable reamer blades 304. In some embodiments, the expandable reamer 300 includes three of the expandable reamer blades 304 symmetrically circumferentially positioned axially along the tubular body 302.

Figure 3:
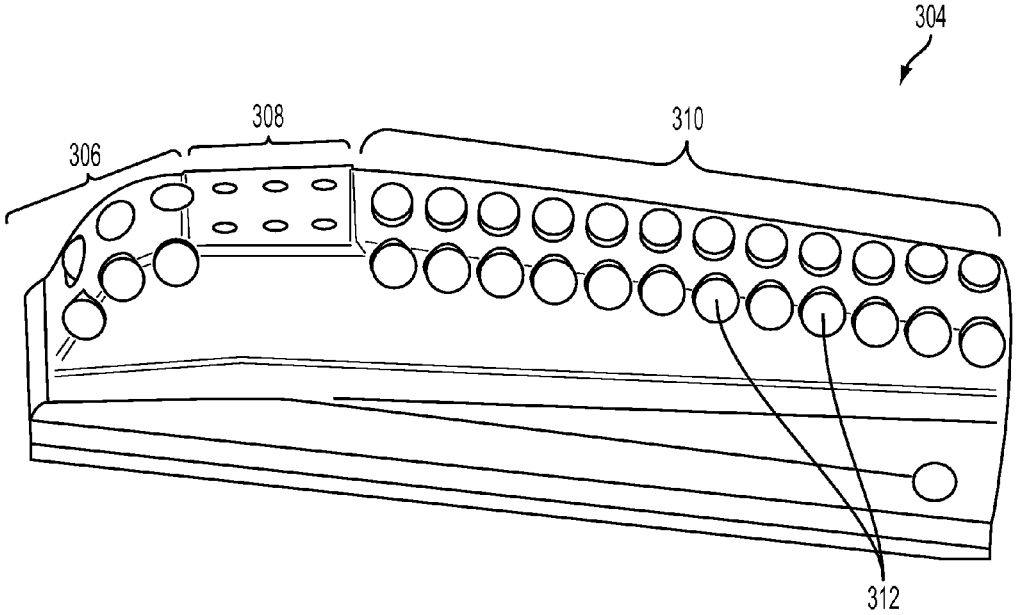
FIG. 3 is a simplified perspective view of an expandable reamer blade in accordance with an embodiment of the disclosure.

One or more of the expandable reamer blades 304 of the extendable reamer 300 may be configured as depicted in FIG. 3. As shown in FIG. 3, which is a simplified perspective view of an expandable reamer blade 304 of FIG. 1 in accordance with an embodiment of the disclosure, an expandable reamer blade 304 may include a first region 306, a second, "gauge" region 308, and a third region 310 each configured to engage the subterranean formation 8 (FIG. 1) between the top of the pilot borehole 12 and the bottom of the casing 6 during reaming of the expanded borehole 14 (FIG. 1). The third region 310 and, optionally, the first region 306 of the expandable reamer blade 304 may carry cutting elements 312 configured and positioned to remove (e.g., by at least one of cutting and scraping) the subterranean formation 8 so as to form the expanded borehole 14 from the pilot borehole 12. The cutting elements 312 may be absent from the gauge region 308 of the expandable reamer blade 304. In turn, the gauge region 308 of the expandable reamer blade 304 may be configured and positioned to engage the subterranean formation 8 at the sidewalls of the expanded borehole 14, and to enhance the stability (e.g., reduce whirl and stick slip vibrations) of the drilling assembly 100 (FIG. 1) during the reaming of the wellbore 10, as described in further detail below. For example, the gauge region 308 of the expandable reamer blade 304 may be configured to substantially limit or prevent formation-engaging surfaces and edges of the gauge region 308 from digging into the sidewalls of the expanded borehole 14 during the reaming of the wellbore 10.

Referring again to FIG. 1, the expandable stabilizer 400 may be an expandable stabilizer configured and operated to reduce vibration, and to provide stabilizing support to one or more components of the drilling assembly 100 (e.g., the expandable reamer 300) as the components rotationally engage the subterranean formation 8. The expandable stabilizer 400 may provide stabilization behind the expandable reamer 300 as it reams the expanded borehole 14. The expandable stabilizer 400 may also be configured and operated to remove obstructions (e.g., slump, swelled shale or filter cake, etc.) formed in the expanded borehole 14 after the reaming thereof by the expandable reamer 300. As shown in FIG. 1, the expandable stabilizer 400 may include a tubular body 402 and expandable stabilizer blades 404. The tubular body 402 may include means (e.g., threaded male pin members, threaded female box members, etc.) at upper and lower ends thereof for connecting to other components of the drilling assembly 100. The expandable stabilizer blades 404 may be positionally retained in a circumferentially spaced relationship between the upper and lower ends of the tubular body 402, and may be symmetrically circumferentially positioned axially along the tubular body 402, or may be positioned circumferentially asymmetrically and/or longitudinally asymmetrically along the tubular body 402. The expandable stabilizer 400 may be configured and operated such that the expandable stabilizer blades 404 extend or retract. For example, expandable stabilizer 400 may be configured and operated such that the expandable stabilizer blades 404 are initially retained in refracted positions within the tubular body 402, and may be moved (e.g., by application or removal of hydraulic pressure) between extended positions (shown in FIG. 1) and refracted positions (not shown) as desired. The expandable stabilizer blades 404 may engage the subterranean formation 8 in an extended position but may not engage the subterranean formation 8 in a refracted position. The expandable stabilizer 400 may include one, two, three, or more than three of the expandable stabilizer blades 404. In some embodiments, the expandable stabilizer 400 includes three of the expandable stabilizer blades 404 symmetrically circumferentially positioned axially along the tubular body 402.

Figure 4:
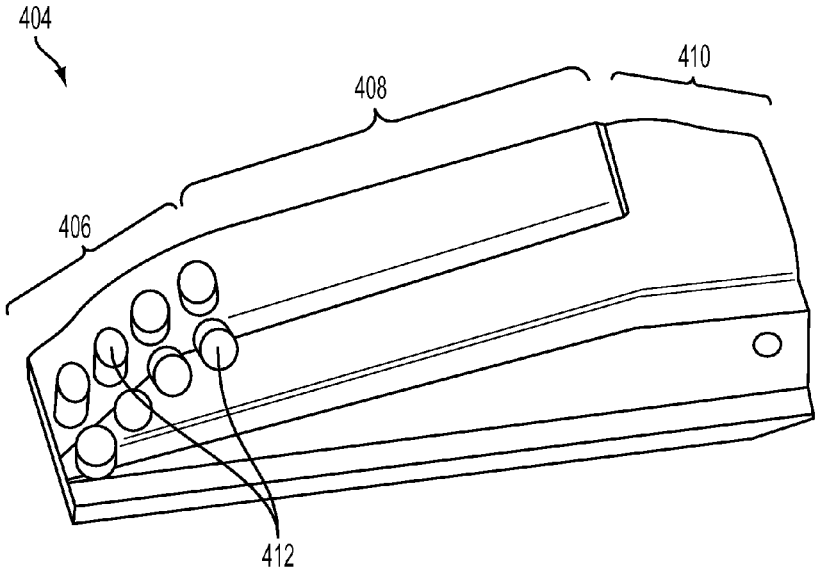
FIG. 4 is a simplified perspective view of an expandable stabilizer blade in accordance with an embodiment of the disclosure.

One or more of the expandable stabilizer blades 404 of the extendable stabilizer 400 may be configured as depicted in FIG. 4. As shown in FIG. 4, which is a simplified perspective view of an expandable reamer blade 404 of FIG. 1 in accordance with an embodiment of the disclosure, an expandable stabilizer blade 404 may include a first region 406, a second, "gauge" region 408, and a third region 410. In some embodiments, the first region 406 of the expandable stabilizer blade 404 may carry cutting elements 412 configured and positioned to remove (e.g., by at least one of cutting and scraping) obstructions formed in the expanded borehole 14 through the reaming thereof by the expandable reamer 300 (FIG. 1). The cutting elements 412 may be absent from the gauge region 408 of the expandable stabilizer blade 404. In additional embodiments, the cutting elements 412 may be absent from each of the first region 406, the gauge region 408, and the third region 410 of the expandable stabilizer blade 404. The gauge region 408 of the expandable stabilizer blade 404 may be configured and positioned to engage the subterranean formation 8 at the sidewalls of the expanded borehole 14, and to enhance the stability (e.g., reduce whirl and stick slip vibrations) of the drilling assembly 100 (FIG. 1) during the reaming of the wellbore 10, as described in further detail below. For example, the gauge region 408 of the expandable stabilizer blade 404 may be configured to substantially limit or prevent formation-engaging surfaces and edges of the gauge region 408 from digging into the sidewalls of the expanded borehole 14 during the reaming of the wellbore 10.

Referring again to FIG. 1, if present, the fixed stabilizer 500 may be a fixed stabilizer configured and operated to reduce vibration, and provide stabilizing support for one or more components of the drilling assembly 100 as the components rotationally engage the subterranean formation 8. The fixed stabilizer 500 may provide stabilization behind the drill bit 200 as it reams the pilot borehole 12, and may provide stabilization ahead of expandable reamer 300 as it reams the expanded borehole 14. As shown in FIG. 1, the fixed stabilizer 500 may include a tubular body 502 and fixed stabilizer blades 504. The tubular body 502 may include means (e.g., threaded male pin members, threaded female box members, etc.) at upper and lower ends thereof for connecting to other components of the drilling assembly 100. The fixed stabilizer blades 504 may be positionally retained in a circumferentially spaced relationship between the upper and lower ends of the tubular body 502, and may be symmetrically circumferentially positioned axially along the tubular body 502, or may be positioned circumferentially asymmetrically and/or longitudinally asymmetrically along the tubular body 502. The fixed stabilizer 500 may include one, two, three, or more than three of the fixed stabilizer blades 504.

One or more of the fixed stabilizer blades 504 of the fixed stabilizer 500 may exhibit a gauge region substantially similar to the gauge region 408 of the expandable stabilizer blade 404 previously described with respect to FIG. 4. For example, the gauge region of one or more of the fixed stabilizer blades 504 may be configured and positioned to engage the subterranean formation 8 at the sidewalls of the pilot borehole 12, and to enhance the stability (e.g., reduce whirl and stick slip vibrations) of the drilling assembly 100 (FIG. 1) during the reaming of the wellbore 10, as described in further detail below. For example, the gauge region of the fixed stabilizer blade 504 may be configured to substantially limit formation-engaging surfaces and edges of the gauge region from digging into the sidewalls of the pilot borehole 12 during the reaming of the wellbore 10. In some embodiments, one or more of the fixed stabilizer blades 504 may also exhibit a first region and a third region substantially similar to the first region 406 and the third region 410 of the expandable stabilizer blade 404, respectively.

Figure 5:
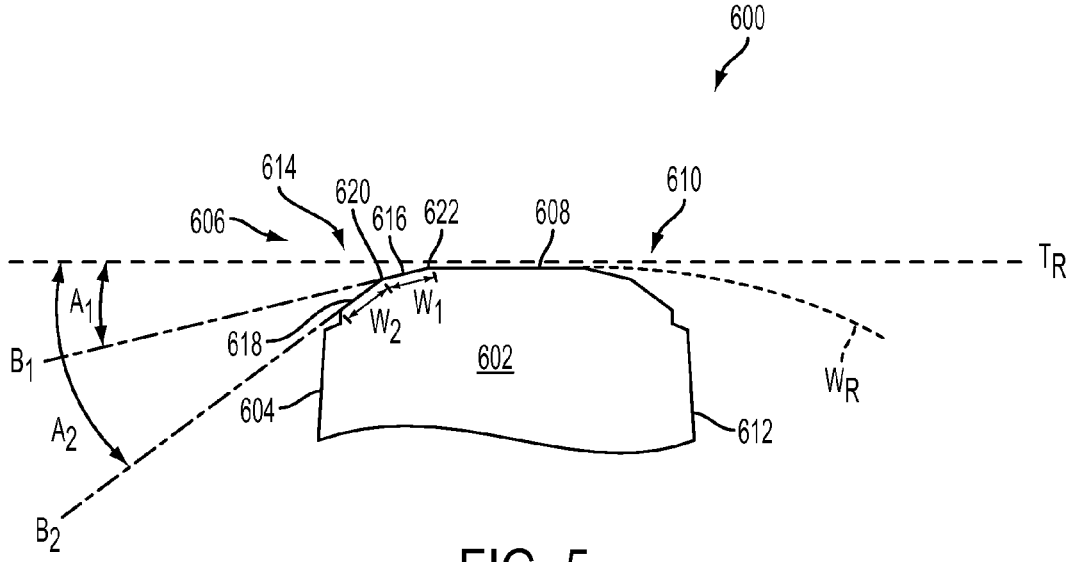
FIG. 5 is a partial, transverse cross-sectional view of a gauge region of a blade in accordance with an embodiment of the disclosure.

FIG. 5 illustrates a partial, transverse cross-sectional view of a gauge region 602 of a blade 600. The gauge region 602 of the blade 600 may correspond to one or more of the gauge region 216 of at least one of the bit blades 204 of the drill bit 200, the gauge region 308 of at least one of the expandable reamer blades 304 of the expandable reamer 300, the gauge region 408 of at least one of the expandable stabilizer blades 404 of the expandable stabilizer 400, and the gauge region of at least one of the fixed stabilizer blades 504 of the fixed stabilizer 500, previously described with respect to FIGS. 1 through 4. As shown in FIG. 5, the gauge region 602 may include a rotationally leading face 604, a rotationally leading edge 606, a bearing face 608, a rotationally trailing edge 610, and a rotationally trailing face 612. The bearing face 608 may be configured to conform to a radius of the wellbore 10 (FIG. 1) (i.e., the "gauge OD" of the component including the blade 600). For example, the bearing face 608 may be substantially flat, or may be at least partially arcuate (e.g., convexly shaped) relative to a tangential reference line $T_R$ perpendicular to the longitudinal axis L (FIG. 1) of the drilling assembly 100 (FIG. 1) and representing a desired engagement between the gauge region 602 of the blade 600 and a sidewall $W_R$ (e.g., a sidewall of the pilot borehole 12, or a sidewall of the expanded borehole 14) of the wellbore 10 (FIG. 1). As described in detail below, an engagement profile 614 of the rotationally leading edge 606 between the bearing face 608 and the rotationally leading face 604 of the gauge region 602 may be configured to provide a smooth and non-aggressive lead into the bearing face 608 to enhance the stability of the drilling assembly 100 during reaming of the wellbore 10.

The engagement profile 614 of the rotationally leading edge 606 of the gauge region 602 may include at least one chamfered (e.g., beveled) surface. For example, as depicted in FIG. 5, the engagement profile 614 may include a first chamfered surface 616 and a second chamfered surface 618. In additional embodiments, the engagement profile 614 of the rotationally leading edge 606 may include a different number of chamfered surfaces, such as one, three, or greater than three chamfered surfaces. The first chamfered surface 616 and the second chamfered surface 618 may extend longitudinally between the rotationally leading face 604 and the bearing face 608 of the gauge region 602 of the blade 600. The first chamfered surface 616 may be substantially linear, and provides a non-aggressive angle $A_1$ (shown in FIG. 5 as the angle between the tangential reference line $T_R$ and a chamfer reference line $B_1$) leading into the bearing face 608 of the gauge region 602 of the blade 600. In turn, the second chamfered surface 618 may also be substantially linear, and provides a transition between the rotationally leading face 604 and the first chamfered surface 616 of gauge region 602 of the blade 600. In additional embodiments, at least one of the first chamfered surface 616 and the second chamfered surface 618 may be at least partially curvilinear (e.g., at least partially arcuate, such as convex). Transitions between the second chamfered surface 618, the first chamfered surface 616, and the bearing face 608 may be smooth and continuous, or may be abrupt (e.g., pronounced), as illustrated by inflection points 620 and 622 in FIG. 5. The first chamfered surface 616 and the second chamfered surface 618 may reduce a tendency of the drilling assembly 100 (FIG. 1) to whirl during reaming of the subterranean formation 8 (FIG. 1) by progressively providing transitional contact with sidewalls of the wellbore 10 (FIG. 1).

As illustrated in FIG. 5, an angle $A_2$ (shown as the angle between the tangential reference line $T_R$ and another chamfer reference line $B_2$) of the second chamfered surface 618 may be greater (e.g., steeper) than the angle $A_1$ of the first chamfered surface 616. For example, in some embodiments, the angle $A_1$ of the first chamfered surface 616 may be about 15 degrees, and the angle $A_2$ of the second chamfered surface 618 may be about 45 degrees (e.g., an angle between the chamfer reference line $B_1$ and the another chamfer reference line $B_2$ may be about 30 degrees). In additional embodiments, at least one of the angle $A_1$ of the first chamfered surface 616 and the angle $A_2$ of the second chamfered surface 618 may be different (e.g., greater than or less than about 15 degrees and about 45 degrees, respectively). By way of non-limiting example, the angle $A_1$ of the first chamfered surface 616 and the angle $A_2$ of the second chamfered surface 618 may respectively be about 10 degrees and about 45 degrees, about 10 degrees and about 50 degrees, about 15 degrees and about 40 degrees, about 15 degrees and about 50 degrees, about 20 degrees and about 40 degrees, about 20 degrees and about 45 degrees, about 20 degrees and about 50 degrees, about 30 degrees and about 40 degrees, or some other combination of angles configured to provide a smooth and non-aggressive lead into the bearing face 608. In embodiments including greater than two chamfered surfaces, each additional chamfered surface may exhibit a progressively steeper angle relative to any chamfered surfaces (e.g., the first chamfered surface 616, and/or the second chamfered surface 618) between the additional chamfered surface and the bearing face 608 of the gauge region 602.

Each of the first chamfered surface 616 and the second chamfered surface 618 may independently exhibit a desired width. A width $W_1$ of the first chamfered surface 616 (e.g., defined by the distance between the inflection points 620 and 622) may be substantially the same as a width $W_2$ of the second chamfered surface 618 (e.g., defined by the distance between the inflection point 620 and a terminus of the second chamfered surface 618), or may be different than (e.g., greater than, or less than) the width $W_2$ of the second chamfered surface 618. For example, the width $W_1$ of the first chamfered surface 616 may be less than the width $W_2$ of the second chamfered surface 618. As a non-limiting example, the width $W_1$ of the first chamfered surface 616 may be within a range of from about 0.5 millimeters (mm) to about 15 mm, and the width $W_2$ of the second chamfered surface 618 may be greater than the width $W_1$ of the first chamfered surface 616 and within a range of from about 2 mm to about 20 mm. As another example, the width $W_1$ of the first chamfered surface 616 may be greater than the width $W_2$ of the second chamfered surface 618. By way of non-limiting example, the width $W_1$ of the first chamfered surface 616 may within a range of from about 2 mm to about 20 mm, and the width $W_2$ of the second chamfered surface 618 may be less than the width $W_1$ of the first chamfered surface 616 and within a range of from about 0.5 mm to about 15 mm. In embodiments including greater than two chamfered surfaces, each additional chamfered surface may exhibit a progressively smaller width or a progressively larger width relative to any chamfered surfaces (e.g., the first chamfered surface 616, and/or the second chamfered surface 618) between the additional chamfered surface and the bearing face 608 of the gauge region 602.

The engagement profile 614 of the rotationally leading edge 606 of the gauge region 602 may be different than an engagement profile of another region of the blade 600. Other regions (not shown) of the blade 600 may, for example, exhibit relatively sharper (i.e., less transitioned) rotationally leading edges than the rotationally leading edge 606 of the gauge region 602 of the blade 600. For example, referring collectively to FIGS. 2 and 5, if at least one of the bit blades 204 of the drill bit 200 is substantially similar to the bit blade 600, a rotationally leading edge of at least one of the cone region 208, the nose region 210, the flank region 212, and the shoulder region 214 may be different (e.g., sharper) than that of the gauge region 216. As another example, referring collectively to FIGS. 3 and 5, if at least one of the expandable reamer blades 304 of the extendable reamer 300 (FIG. 1) is substantially similar to the bit blade 600, a rotationally leading edge of at least one of the first region 306, and the third region 310 may be different (e.g., sharper) than that of the gauge region 308 of the expandable reamer blade 304. As yet another example, referring collectively to FIGS. 4 and 5, if at least one of the expandable stabilizer blades 404 of the extendable stabilizer 400 (FIG. 1) is substantially similar to the bit blade 600, a rotationally leading edge of at least one of the first region 406, and the third region 410 may be different (e.g., sharper) than that of the gauge region 408 of the expandable stabilizer blade 404. As yet still another example, referring collectively to FIGS. 1 and 5, if at least one of the fixed stabilizer blades 504 of the fixed stabilizer 500 is substantially similar to the bit blade 600, a rotationally leading edge of at least one of the other region of the fixed stabilizer blade 504 may be different (e.g., sharper) than that of the gauge region of the fixed stabilizer blade 504.

In some embodiments, an engagement profile of a rotationally leading edge of each of the gauge region 216 of each of the bit blades 204 of the drill bit 200, the gauge region 308 of each of the expandable reamer blades 304 of the expandable reamer 300, the gauge region 408 of each of the expandable stabilizer blades 404 of the expandable stabilizer 400, and the gauge region of each of the fixed stabilizer blades 504 of the fixed stabilizer 500 may be substantially similar to the engagement profile 614 of the rotationally leading edge 606 of the blade 600. In additional embodiments, an engagement profile of a rotationally leading edge of one or more of the gauge regions 216 of at least one of the bit blades 204 of the drill bit 200, the gauge region 308 of at least one of the expandable reamer blades 304 of the expandable reamer 300, the gauge region 408 of at least one of the expandable stabilizer blades 404 of the expandable stabilizer 400, and the gauge region of at least one of the fixed stabilizer blades 504 of the fixed stabilizer 500 may be different than (e.g., substantially free of chamfered surfaces, exhibiting different chamfered surfaces, exhibiting substantially radiused surfaces, etc.) the engagement profile 614 of the rotationally leading edge 606 of the gauge region 602 of the blade 600. If less than all of the gauge regions of blades of a particular component (e.g., the drill bit 200, the expandable reamer 300, expandable stabilizer 400, the fixed stabilizer 500) of the drilling assembly 100 include a rotationally leading edge engagement profile substantially similar to the engagement profile 614 of the rotationally leading edge 606 of the gauge region 602 of the blade 600, the engagement profile 614 may be included upon different blades of the particular component in a symmetric fashion or in an asymmetric fashion.

Figure 6:
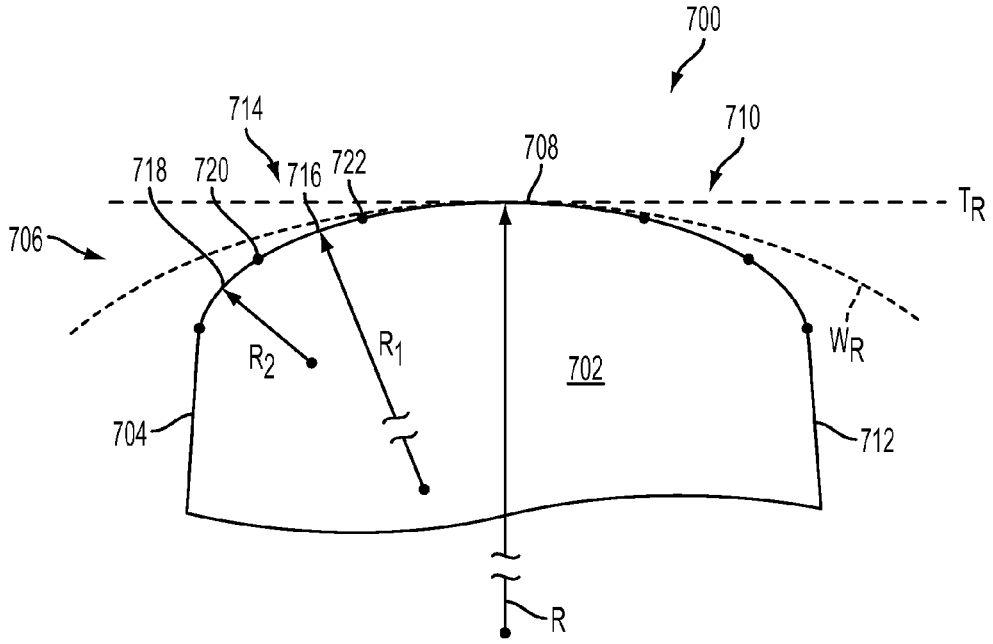
FIG. 6 is a partial, transverse cross-sectional view of a gauge region of another blade in accordance with an embodiment of the disclosure.

FIG. 6 illustrates a partial, transverse cross-sectional view of a gauge region 702 of a blade 700. The gauge region 702 of the blade 700 may correspond to at least one of the gauge region 216 of at least one of the bit blades 204 of the drill bit 200, the gauge region 308 of at least one of the expandable reamer blades 304 of the expandable reamer 300, the gauge region 408 of at least one of the expandable stabilizer blades 404 of the expandable stabilizer 400, and the gauge region of at least one of the fixed stabilizer blades 504 of the fixed stabilizer 500, as previously described with respect to FIGS. 1 through 4. As shown in FIG. 6, the gauge region 702 may include a rotationally leading face 704, a rotationally leading edge 706, a bearing face 708, a rotationally trailing edge 710, and a rotationally trailing face 712. The bearing face 708 may be configured to conform to a radius of the wellbore 10 (FIG. 1) (i.e., the "gauge OD" of the tool including the blade 700). For example, the bearing face 708 may be substantially flat, or may be at least partially arcuate (e.g., convexly shaped) relative to a tangential reference line $T_R$ perpendicular to the longitudinal axis L (FIG. 1) of the drilling assembly 100 (FIG. 1) and representing the desired engagement between the gauge region 702 of the blade 700 and a sidewall $W_R$ (e.g., a sidewall of the pilot borehole 12, or a sidewall of the expanded borehole 14) of the wellbore 10 (FIG. 1). Similar to the engagement profile 614 of the rotationally leading edge 606 described in relation to FIG. 5, an engagement profile 714 of the rotationally leading edge 706 between the bearing face 708 and the rotationally leading face 704 of the gauge region 702 may be configured to provide a smooth and non-aggressive lead into the bearing face 708 to enhance the stability of the drilling assembly 100 (FIG. 1) during reaming of the wellbore 10.

The engagement profile 714 of the rotationally leading edge 706 of the gauge region 702 may include at least one radiused (e.g., arcuate) surface. For example, as depicted in FIG. 6, the engagement profile 714 may include a first radiused surface 716 and a second radiused surface 718. In additional embodiments, the engagement profile 714 of the rotationally leading edge 706 may include a different number of radiused surfaces, such as one, three, or greater than three radiused surfaces. The first radiused surface 716 and the second radiused surface 718 may extend longitudinally between the rotationally leading face 704 and the bearing face 708 of the gauge region 702 of the blade 700. The first radiused surface 716 may be substantially arcuate, and provides a smooth and non-aggressive radius of curvature $R_1$ leading into the bearing face 708 of the gauge region 702 of the blade 700. In turn, the second radiused surface 718 may also be substantially arcuate, and provides a transition between the rotationally leading face 704 and the first radiused surface 716 of the gauge region 702 of the blade 700. In additional embodiments, at least one of the first radiused surface 716 and the second radiused surface 718 may be at least partially linear. Transitions between the second radiused surface 718, the first radiused surface 716, and the bearing face 708 may be smooth and continuous, or may be abrupt, as illustrated by transition points 720 and 722 in FIG. 6. Similar to the first chamfered surface 616 and the second chamfered surface 618 previously described in relation to FIG. 5, the first radiused surface 716 and the second radiused surface 718 may reduce a tendency of the drilling assembly 100 (FIG. 1) to whirl during reaming of the subterranean formation 8 (FIG. 1) by progressively providing transitional contact with sidewalls of the wellbore 10 (FIG. 1).

As shown in FIG. 6, a radius of curvature $R_2$ of the second radiused surface 718 may be smaller (e.g., steeper) than the radius of curvature $R_1$ of the first radiused surface 716. By way of non-limiting example, the radius of curvature $R_1$ of the first radiused surface 716 may be greater than or equal to about 3 mm (e.g., greater than or equal to about 4 mm, greater than or equal to about 5 mm, greater or equal to about 7 mm, or greater than or equal to about 10 mm), and the radius of curvature $R_2$ of the second radiused surface 718 may be less than about 3 mm (e.g., less than or equal to about 2.5 mm, less than or equal to about 2 mm, less than or equal to about 1.5 mm, or less than or equal to about 1 mm). In some embodiments, the radius of curvature $R_1$ of the first radiused surface 716 is within a range of from about 3 mm to about 10 mm, and the radius of curvature $R_2$ of the second radiused surface 718 is within a range of from about 0.5 mm to about 1.5 mm. The radius of curvature $R_1$ of the first radiused surface 716 and the radius of curvature $R_2$ of the second radiused surface 718 may each be smaller than an effective radius of curvature R of the bearing face 708. In embodiments including greater than two radiused surfaces, each additional radiused surface may exhibit a progressively smaller radius of curvature relative to any other radiused surfaces (e.g., the first radiused surface 716, and/or the second radiused surface 718) between the additional radiused surface and the bearing face 708 of the gauge region 702.

Similar to the engagement profile 614 of the rotationally leading edge 606 of the gauge region 602 of the blade 600 previously described in relation to FIG. 5, the engagement profile 714 of the rotationally leading edge 706 of the gauge region 702 may be different than an engagement profile of another region of the blade 700. Other regions (not shown) of the blade 700 may, for example, exhibit relatively shaper (i.e., less transitioned) rotationally leading edges than the rotationally leading edge 706 of the gauge region 702 of the blade 700.

While FIGS. 5 and 6 respectively show blades 600, 700 including gauge regions 602, 702 exhibiting rotationally leading edges 606, 706 including engagement profiles 614, 714 including at least one chamfered surface (e.g., the first chamfered surface 616, and the second chamfered surface 618) or at least one radiused surface (e.g., the first radiused surface 716, and the second radiused surface 718), the disclosure is not so limited. In additional embodiments, at least one blade of the drilling assembly 100 (FIG. 1) (e.g., at least one blade of one or more of the drill bit 200, the expandable reamer 300, expandable stabilizer 400, and the fixed stabilizer 500) may include a gauge region including a rotationally leading edge exhibiting an engagement profile including a combination of at least one chamfered surface and at least one radiused surface. The at least one chamfered surface and the at least one radiused surface may respectively have any desired angle and radius of curvature, and may be provided in any desired arrangement relative one another, so long as the combination of the at least one chamfered surface and the at least one radiused surface enhances the stability of the drilling assembly 100 during reaming of the wellbore 10 (FIG. 1).

Referring generally to FIG. 1, a drilling assembly 100 including one or more components (e.g., at least one of the drill bit 200, the expandable reamer 300, the expandable stabilizer 400, and the fixed stabilizer 500) including at least one blade (e.g., at least one of a bit blade 204, an expandable reamer blade 304, an expandable stabilizer blade 404, and a fixed stabilizer blade 504, respectively) including a gauge region exhibiting a rotationally leading edge engagement profile of the disclosure may exhibit a pronounced improvement over conventional drilling assemblies not including one or more components including at least one blade including a gauge region exhibiting a rotationally leading edge engagement profile of the disclosure. The rotationally leading edge engagement profiles of the disclosure may increase the stability (e.g., reducing whirl and lateral vibration) of the drilling assembly 100 during reaming operations by facilitating a relatively smoother rotational transition between a rotationally leading face and a bearing face of the gauge region of the blade during reaming of the subterranean formation 8 to form the wellbore 10.

Therefore, in accordance with embodiments of the disclosure, a method for stabilizing a drilling assembly 100 in a wellbore 10 in a subterranean formation 8 may include positioning in the wellbore 10, with the drilling assembly 100, at least one of a drill bit 200, an expandable reamer 300, an expandable stabilizer 400, and a fixed stabilizer 500 including at least one blade 600, 700 (FIGS. 5 and 6) exhibiting a gauge region 602, 702 (FIGS. 5 and 6) including an engagement profile 614, 714 (FIGS. 5 and 6) of a rotationally leading edge 606, 706 (FIGS. 5 and 6) configured to engage a sidewall of the wellbore 10 and to enhance the stability of the drilling assembly 100 during rotation in the wellbore 10, and rotating the drilling assembly 100.

With continued reference to FIG. 1, as formation-engaging surfaces of the gauge regions of the blades of the various components of the drilling assembly 100 slide and scrape against the subterranean formation 8 during reaming of the wellbore 10, the material at the formation-engaging surfaces may have a tendency to wear away. The wearing away of the material at the formation-engaging surfaces may, in turn, lead to instability in the drilling assembly 100. Accordingly, the gauge region of one or more of the blades of one or more components of the drilling assembly 100 (e.g., the gauge region 216 of each of the bit blades 204 of the drill bit 200, the gauge region 308 of each of the expandable reamer blades 304 of the expandable reamer 300, the gauge region 408 of each of the expandable stabilizer blades 404 of the expandable stabilizer 400, the gauge region of each of the fixed stabilizer blades 504 of the fixed stabilizer 500, etc.) may include at least one material for enhancing the wear resistance of the formation-engaging surfaces and edges of the gauge region, as described in further detail below.

Figure 7A:
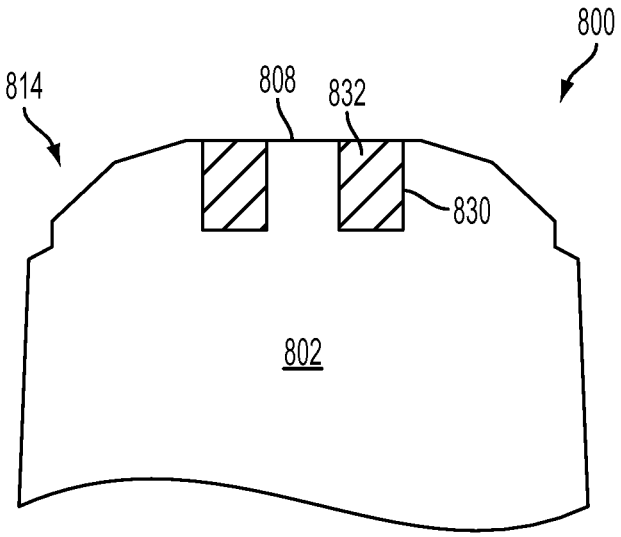
FIGS. 7A and 7B are partial, transverse cross-sectional (FIG. 7A) and top-down (FIG. 7B) views of a gauge region of a blade including wear-resistant structures in a bearing surface thereof, in accordance with an embodiment of the disclosure.

FIG. 7A is a partial, transverse cross-sectional view depicting a gauge region 802 of a blade 800. The gauge region 802 of the blade 800 may be substantially similar to the gauge region 602 of the blade 600 previously described with respect to FIG. 5, except that a bearing face 808 of the gauge region 802 includes recesses 830 peripherally surrounding wear-resistant structures 832 configured and positioned to enhance the wear-resistance of the gauge region 802 (e.g., the wear resistance of the formation-engaging surfaces of the gauge region 802). The bearing face 808 may include any desired number of the recesses 830, such as greater than or equal to two recesses. By way of non-limiting example, referring to FIG. 7B, which illustrates a simplified top-down view of the gauge region 802 of the blade 800 shown in FIG. 7A, the bearing face 808 may include six recesses 830 each peripherally surrounding a respective wear-resistant structure 832. In additional embodiments, the bearing face 808 may include a single (i.e., one) recess 830 rather than multiple recesses 830.

Figure 7B:
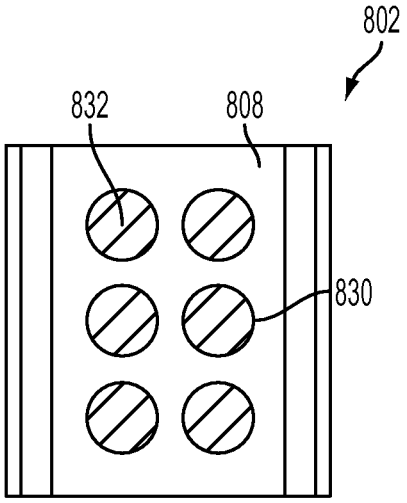

Each of the recesses 830 may independently have a desired shape, a desired size, and a desired spacing relative to each other of the recesses 830. For example, as depicted in FIG. 7B, each of the recesses 830 may have a substantially circular cross-sectional shape, may have substantially the same size, and may be spaced from adjacent recesses by substantially the same distance. In additional embodiments, at least one of the recesses 830 may exhibit one or more of a different cross-sectional shape (e.g., a circular, semicircular, ovular, annular, astroidal, deltoidal, ellipsoidal, triangular, tetragonal, pentagonal, hexagonal, heptagonal, octagonal, enneagonal, decagonal, truncated versions thereof, or irregular cross-sectional shape), a different size, and a different spacing as compared to at least one other of the recesses 830. The recesses 830 may be formed using conventional processes and equipment, which are not described in detail herein.

The wear-resistant structures 832 in the recesses 830 may each independently be formed of and include at least one wear-resistant material. As used herein, the term "wear-resistant material" means and includes a material exhibiting enhanced resistance to at least one of abrasive wear and erosive wear. The wear-resistant material may, for example, comprise at least one ultra-hard material, such as natural diamond, a polycrystalline diamond (PCD) material, a ceramic-metal composite material (i.e., a "cermet" material), and a thermally stable product (TSP). PCD materials may include inter-bonded grains or crystals of diamond dispersed throughout a metal matrix material (e.g., a catalyst material). Cermet materials may comprise hard ceramic phase regions or particles dispersed throughout a metal matrix material. The hard ceramic phase regions or particles may comprise carbides, nitrides, oxides, and borides (including boron carbide), such as carbides and borides of at least one of tungsten (W), titanium (Ti), molybdenum (Mo), niobium (Nb), vanadium (V), hafnium (Ha), tantalum (Ta), chromium (Cr), zirconium (Zr), aluminum (Al), and silicon (Si). By way of non-limiting example, the hard ceramic phase regions or particles may comprise one or more of tungsten carbide, titanium carbide, tantalum carbide, titanium diboride, chromium carbides, titanium nitride, aluminum oxide, aluminum nitride, and silicon carbide. Metal matrix materials may include, for example, cobalt-based, iron-based, nickel-based, iron- and nickel-based, cobalt and nickel-based, iron- and cobalt-based, aluminum-based, copper-based, magnesium-based, and titanium-based alloys. The metal matrix material may also be selected from commercially pure elements such as cobalt, aluminum, copper, magnesium, titanium, iron, and nickel. The TSP may, for example, be an ultra-hard material substantially free of metal matrix material, such as a PCD material substantially free of metal matrix material.

At least one of the wear-resistant structures 832 in the recesses 830 may comprise a structure formed outside of the recesses 830 and subsequently inserted into one of the recesses 830. Put another way, at least one of the wear-resistant structures 832 may comprise a previously formed structure, such as a previously formed cube, cuboid, brick, block, stud, cylinder, ovoid, pyramid, prism, wear knot, or other structural configuration of at least one wear-resistant material inserted into one of the recesses 830. Suitable previously formed structures (e.g., inserts) include, but are not limited to, conventional PCD cutting elements; natural diamonds; structural configurations (e.g., cubes, cuboids, bricks, blocks, studs, cylinders, ovoids, pyramids, prisms, wear knots, etc.) of at least one of a PCD material, a cermet material, and a TSP; and structures (e.g., structures formed of and including at least one of a PCD material, a cermet material, and a TSP) at least partially covered with at least one of a PCD material, a cermet material, and a TSP. The previously formed structure may be formed using conventional methods and equipment, which are not described in detail herein. The previously formed structure and may also be inserted and secured (e.g., attached) within one of the recesses 830 using conventional methods (e.g., welding, brazing, pressed-fitting, etc.) and equipment, which are also not described in detail herein.

In additional embodiments, at least one of the wear-resistant structures 832 in the recesses 830 may comprise a structure formed within one of the recesses 830. For example, at least one of the wear-resistant structures 832 may be a structure formed through depositing at least one wear-resistant material into one of the recesses 830. The wear-resistant material may, for example, be a conventional "hardfacing" material, such as that described in U.S. Pat. No. 6,248,149, which issued Jun. 19, 2001, and is titled "Hardfacing Composition for Earth-Boring Bits Using Macrocrystalline Tungsten Carbide and Spherical Cast Carbide," the disclosure of which is incorporated herein in its entirety by this reference. The wear-resistant material may be selectively deposited into one or more of the recesses 830 to form at least one of the wear-resistant structures 832, or may be bulk deposited over the bearing face 808 and into the recesses 830 to form at least one of the wear-resistant structures 832. The wear-resistant material may be deposited in the one or more of the recesses 830 using conventional processes (e.g., a welding process, a flame spray process, etc.) and equipment, which are not described in detail herein.

Exposed surfaces of the wear-resistant structures 832 may be substantially coextensive (e.g., coplanar, flush, level, etc.) with the bearing face 808 of the gauge region 802 of the blade 800. Put another way, the wear-resistant structures 832 may not project (e.g., extend) significantly beyond the bearing face 808 of the gauge region 802 of the blade 800. Accordingly, the topography of the bearing face 808 of the gauge region 802 after providing the wear-resistant structures 832 within the recesses 830 may be substantially similar to the topography of the bearing face 808 of the gauge region 802 prior to forming the recesses 830. By substantially maintaining the original topography of the bearing face 808 of the gauge region 802, forces applied to the bearing face 808 of the gauge region 802 may be evenly distributed across the gauge region 802 of the blade 800, which may reduce or eliminate localized stresses and may increase the service life of the blade 800. The exposed surfaces of the wear-resistant structures 832 may be made substantially coplanar with the bearing face 808 of the gauge region 802 using conventional methods (e.g., planarization methods, etc.) and equipment, which are not described in detail herein. In additional embodiments, a portion of one or more of the wear-resistant structures 832 may project beyond the bearing face 808 of the gauge region 802 of the blade 800.

The wear-resistant structures 832 may each be substantially the same, or at least one of the wear-resistant structures 832 may be different than at least one other of the wear-resistant structures 832. In some embodiments, each of the wear-resistant structures 832 exhibits substantially the same size, shape, and material composition as each other of the wear-resistant structures 832. In additional embodiments, at least one of the wear-resistant structures 832 exhibits at least one of a different size, a different shape, and a different material composition than at least one other of the wear-resistant structures 832. In addition, the wear-resistant structures 832 may only comprise structures formed outside the recesses 830 and subsequently inserted therein, may only comprise structures formed within the recesses 830, or may comprise a combination of structures formed outside the recesses 830 and subsequently inserted therein and structures formed within the recesses 830.

Figure 8:
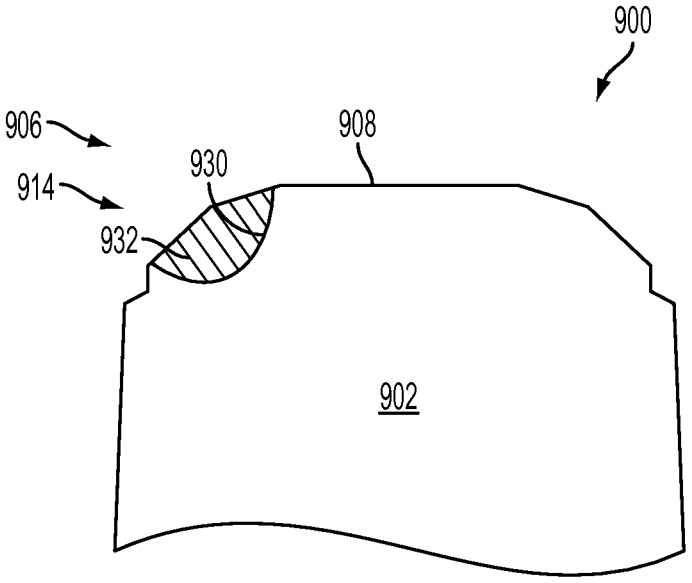
FIG. 8 is a partial, transverse cross-sectional view of a gauge region of a blade including wear-resistant structures in a rotationally leading edge thereof, in accordance with an embodiment of the disclosure.

In additional embodiments, at least one wear-resistant structure may be provided in, on, or over other formation-engaging surfaces of a gauge region of at least one blade of one or more components of the drilling assembly 100 (FIG. 1). For example, the gauge region of at least one blade of one or more components of the drilling assembly 100 may be configured as depicted in FIG. 8. FIG. 8 is a partial, transverse cross-sectional view depicting a gauge region 902 of a blade 900. The gauge region 902 of the blade 900 may be substantially similar to the gauge region 602 of the blade 600 previously described with respect to FIG. 5, except that a rotationally leading edge 906 of the gauge region 902 may include recesses 930 peripherally surrounding wear-resistant structures 932 configured and positioned to enhance the wear-resistance of the gauge region 902 while maintaining the previously-described non-aggressive lead into the bearing facing 908. The recesses 930 and the wear-resistant structures 932 may respectively be substantially similar (e.g., in at least one of number, size, shape, spacing, and material composition) to the recesses 830 and the wear-resistant structures 832 previously-described with respect to FIGS. 7A and 7B, except located in the leading edge 906 of the gauge region 902 rather than in a bearing surface 908 of the gauge region 902. In some embodiments, exposed surfaces of the wear-resistant structures 932 may be processed (e.g., planarized) to conform a desired engagement profile 914 (e.g., substantially similar to the engagement profile 614 of the gauge region 602 of the blade 600 previously described with respect to FIG. 5) of the rotationally leading edge 906. In additional embodiments, such processing of the wear-resistant structures 932 may, optionally, be omitted so long as the engagement profile 914 at least partially defined by the wear-resistant structures 932 provides a non-aggressive lead into the bearing face 908.

The gauge region of one or more blades of one or more components of the drilling assembly 100 (FIG. 1) may include recesses and wear-resistant structures at less than all of the formation-engaging surfaces of the gauge region. For example, as depicted in FIG. 7A, the gauge region 802 of the blade 800 may include the recesses 830 and the wear-resistant structures 832 at the bearing face 808, but may not include recesses and wear-resistant structures at a rotationally leading edge 814 thereof. As another example, as depicted in FIG. 8, the gauge region 902 of the blade 900 may include the recesses 930 and the wear-resistant structures 932 at the rotationally leading edge 906, but may not include recesses and wear-resistant structures at a bearing surface 908 thereof. In additional embodiments, the gauge region of one or more blades of one or more components of the drilling assembly 100 may include wear-resistant structures in all of the formation-engaging surfaces of the gauge region, such as at both a bearing surface and a rotationally leading edge of the gauge region.

Figure 9:
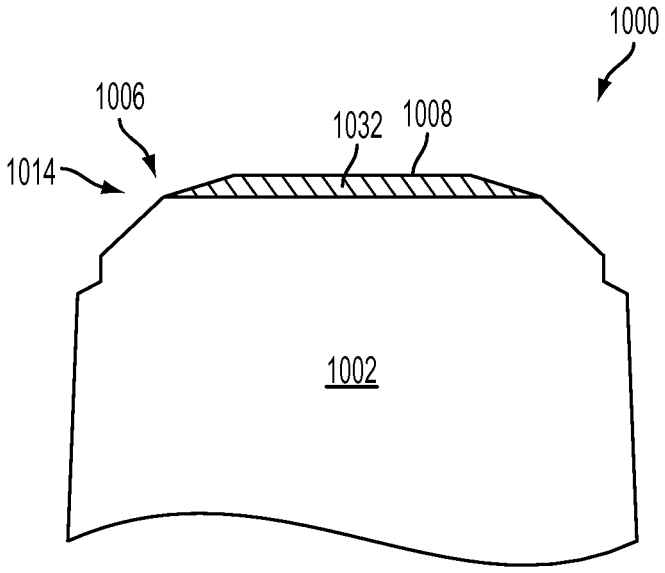
FIG. 9 is a partial, transverse cross-sectional view of a gauge region of a blade including wear-resistant material at least partially overlying a bearing surface and a rotationally leading edge thereof, in accordance with an embodiment of the disclosure.

In further embodiments, a wear-resistant material may be formed on or over at least one formation-engaging surface of a gauge region of one of more blades of at least one component of the drilling assembly 100 without first forming recesses (e.g., the recesses 830 shown in FIG. 7A, the recesses 930 shown in FIG. 8) in the at least one formation-engaging surface. For example, the gauge region of at least one blade of one or more components of the drilling assembly 100 may be configured as depicted in FIG. 9. FIG. 9 is a partial, transverse cross-sectional view depicting a gauge region 1002 of a blade 1000 including a wear-resistant material 1032 thereover. The gauge region 1002 of the blade 1000 may be substantially similar to the gauge region 602 of the blade 600 previously described with respect to FIG. 5, except that the wear-resistant material 1032 may define at least a portion of the formation-engaging surfaces of the gauge region 1002. For example, as depicted in FIG. 9, the wear-resistant material 1032 may define a bearing surface 1008 of the gauge region 1002 and a portion (e.g., surface) of a rotationally leading edge 1006 of the gauge region 1002. The wear-resistant material 1032 may comprise, for example, at least one conventional hardfacing material, such as that previously described in relation to FIG. 7A. The wear-resistant material 1032 may comprise at least one layer of the hardfacing material, such as a single layer of the hardfacing material, or greater than or equal to two layers of the hardfacing material. In some embodiments, exposed surfaces of the wear-resistant material 1032 may be processed (e.g., planarized) to conform a desired engagement profile 1014 (e.g., substantially similar to the engagement profile 614 of the gauge region 602 of the blade 600 previously described with respect to FIG. 5) of the rotationally leading edge 1006. In additional embodiments, such processing of the wear-resistant material 1032 may, optionally, be omitted so long as the engagement profile 1014 at least partially defined by the wear-resistant material 1032 provides a non-aggressive lead into the bearing face 1008. The wear-resistant material 1032 may be formed on or over formation-engaging surfaces of the gauge region 1002 of the blade 1000 using conventional processes (e.g., a welding process, a flame spray process, planarization processes, etc.) and equipment, which are not described in detail herein.

Referring again to FIG. 1, providing the gauge region of one or more blades of at least one component (e.g., drill bit 200, the expandable reamer 300, the expandable stabilizer 400, the fixed stabilizer 500) of the drilling assembly 100 with at least one wear-resistant material may reduce wearing away of material of the gauge region during reaming of the wellbore 10 in the subterranean formation 8, thereby allowing embodiments of blades of the disclosure to properly function for longer periods of time and through the operational life of the drilling assembly 100.

While the disclosure is susceptible to various modifications and alternative forms, specific embodiments have been shown by way of example in the drawings and have been described in detail herein. However, the disclosure is not intended to be limited to the particular forms disclosed. Rather, the disclosure is to cover all modifications, equivalents, and alternatives falling within the scope of the disclosure as defined by the following appended claims and their legal equivalents.

What is claimed is:

1. An expandable reamer of a drilling assembly, comprising:

a tubular body; and at least one blade switchable between an extended position and a retracted position relative to the body and comprising:

a gauge region comprising:

a bearing face for engaging a wall of a borehole in a subterranean formation during rotation of the drilling assembly; and a rotationally leading edge rotationally preceding the bearing face, the rotationally leading edge free of structures embedded therein and exhibiting a first engagement profile comprising one or more of at least one chamfered surface and at least one radiused surface; and at least one additional region adjacent the gauge region and comprising:

an additional rotationally leading edge having cutting elements embedded therein, the additional rotationally leading edge exhibiting a second engagement profile different than the first engagement profile of the rotationally leading edge of the gauge region.

2. The expandable reamer of claim 1, wherein the first engagement profile comprises at least one of a plurality of chamfered surfaces and a plurality of radiused surfaces.

3. The expandable reamer of claim 1, wherein the gauge region is substantially free of cutting elements configured and positioned to remove material of the subterranean formation during rotation of the drilling assembly.

4. The expandable reamer of claim 1, wherein the first engagement profile of the gauge region comprises a plurality of chamfered surfaces, each chamfered surface of the plurality of chamfered surfaces comprising a different angle relative to a reference line tangential to the bearing face than each other chamfered surface of the plurality of chamfered surfaces.

5. The expandable reamer of claim 1, wherein the first engagement profile of the gauge region comprises:

a first chamfered surface adjacent the bearing face; and a second chamfered surface adjacent the first chamfered surface, the second chamfered surface exhibiting a greater angle relative to a reference line tangential to the bearing face than the first chamfered surface.

6. The expandable reamer of claim 5, wherein the first chamfered surface exhibits a first angle of 15 degrees relative to a reference line tangential to the bearing face, and wherein the second chamfered surface exhibits a second angle of 45 degrees relative to the reference line tangential to the bearing face.

7. The expandable reamer of claim 1, wherein the first engagement profile of the gauge region comprises a plurality of radiused surfaces, each radiused surface of the plurality of radiused surfaces comprising a different radius of curvature than each other radiused surface of the plurality of radiused surfaces.

8. The expandable reamer of claim 1, wherein the first engagement profile of the gauge region comprises:

a first radiused surface adjacent the bearing face; and a second radiused surface adjacent the first radiused surface, the second radiused surface exhibiting a smaller radius of curvature than the first radiused surface.

9. The expandable reamer of claim 8, wherein the first radiused surface exhibits a first radius of curvature within a range of from 0.5 mm to 1.5 mm, and wherein the second radiused surface exhibits a second radius of curvature within a range of from 3 mm to 10 mm.

10. The expandable reamer of claim 1, further comprising at least one wear-resistant material within at least one recess in the bearing face of the gauge region.

11. The expandable reamer of claim 10, wherein the at least one wear-resistant material comprises at least one ultra-hard material selected from the group consisting of natural diamond, a polycrystalline diamond material, and a ceramic-metal composite material.

12. The expandable reamer of claim 10, wherein the least one wear-resistant material comprises at least one of a cube, a cuboid, a brick, a block, a stud, a cylinder, an ovoid, a pyramid, a prism, and a wear knot.

13. The expandable reamer of claim 1, further comprising at least one layer of at least one wear-resistant material defining at least a portion of at least one of the bearing face and the rotationally leading edge of the gauge region.

14. A drilling assembly comprising:

at least one expandable reamer comprising:

a tubular body; and at least one blade switchable between an extended position and a retracted position and comprising:

a gauge region exhibiting a continuous rotationally leading edge having an engagement profile comprising one or more of:

a plurality of radiused surfaces each exhibiting a different radius of curvature; and a plurality of chamfered surfaces each exhibiting a different angle relative to one another; and another region adjacent the gauge region and exhibiting a discontinuous rotationally leading edge having another engagement profile different than that of the engagement profile of the continuous rotationally leading edge of the gauge region.

15. The drilling assembly of claim 14, wherein the at least one blade comprises a plurality of blades, each of the plurality of blades independently comprising the gauge region exhibiting the continuous rotationally leading edge.

16. The drilling assembly of claim 15, wherein each of the plurality of blades exhibits substantially the same engagement profile of the continuous rotationally leading edge of the gauge region thereof.

17. The drilling assembly of claim 14, further comprising at least one wear-resistant structure within at least one recess in at least one formation-engaging surface of the gauge region of the at least one blade of the at least one expandable reamer.

18. The drilling assembly of claim 14, further comprising at least one layer of at least one wear-resistant material at least partially defining at least a portion of at least one formation-engaging surface of the at least one blade of the at least one expandable reamer.

19. The drilling assembly of claim 14, wherein the discontinuous rotationally leading edge of the another region of the at least one blade comprises a rotationally leading edge of the another region exhibiting cutting elements embedded therein.

20. A method of stabilizing a drilling assembly in wellbore in a subterranean formation, comprising:

forming the drilling assembly to comprise at least one expandable reamer comprising:

a tubular body; and at least one blade switchable between an extended position and a retracted position relative to the tubular body and comprising:

a gauge region comprising a bearing face and a continuous rotationally leading edge rotationally preceding the bearing face, the continuous rotationally leading edge exhibiting an engagement profile comprising one or more of:

a plurality of radiused surfaces each exhibiting a different radius of curvature; and a plurality of chamfered surfaces each exhibiting a different angle relative to one another; and another region adjacent the gauge region and comprising a discontinuous rotationally leading edge exhibiting another engagement profile different than that of the engagement profile of the continuous rotationally leading edge of the gauge region;

rotating the drilling assembly; and engaging a sidewall of the wellbore with the at least one of the plurality of radiused surfaces and the plurality of chamfered surfaces of the continuous rotationally leading edge of the gauge region of the at least one blade of the at least one expandable reamer.

* * * * *